US008395828B2

(12) United States Patent
Miyazaki

(10) Patent No.: US 8,395,828 B2
(45) Date of Patent: Mar. 12, 2013

(54) STACKING DEVICE AND IMAGE FORMING APPARATUS COMPRISING THE STACKING DEVICE

(75) Inventor: Yasuhiro Miyazaki, Hachioji (JP)

(73) Assignee: Olympus Corporation, Tokyo (JP)

( * ) Notice: Subject to any disclaimer, the term of this patent is extended or adjusted under 35 U.S.C. 154(b) by 270 days.

(21) Appl. No.: 12/952,439

(22) Filed: Nov. 23, 2010

(65) Prior Publication Data

US 2011/0063690 A1 Mar. 17, 2011

Related U.S. Application Data

(63) Continuation of application No. PCT/JP2009/059549, filed on May 25, 2009.

(30) Foreign Application Priority Data

May 23, 2008 (JP) ..... 2008-135895

(51) Int. Cl.
*H04N 1/04* (2006.01)

(52) U.S. Cl. ..... 358/498; 358/471; 358/1.15; 358/296; 270/58.07; 270/58.12; 271/117; 271/162; 399/307; 399/403

(58) Field of Classification Search ..... 358/471, 358/498, 1.15, 401, 296, 406, 474; 270/58.07, 270/37, 58.11, 58.12, 58.06, 4, 45; 271/34, 271/71, 253, 162, 241, 221, 207, 1.01, 127, 271/117, 122; 399/307, 410, 85, 408, 403
See application file for complete search history.

(56) References Cited

U.S. PATENT DOCUMENTS

| | | | | |
|---|---|---|---|---|
| 2,925,271 | A | 2/1960 | Faeber | |
| 3,154,307 | A | 10/1964 | Williamson | |
| 5,639,079 | A * | 6/1997 | Suzuki et al. | 270/58.17 |
| 5,938,186 | A * | 8/1999 | Sato et al. | 270/58.11 |
| 5,951,000 | A * | 9/1999 | Sato et al. | 270/58.11 |
| 6,427,997 | B1 * | 8/2002 | Hirota et al. | 270/58.12 |
| 6,561,503 | B1 * | 5/2003 | Ogata et al. | 270/58.12 |
| 6,575,446 | B2 * | 6/2003 | Wakabayashi et al. | 270/58.07 |
| 6,672,582 | B2 | 1/2004 | Dittli et al. | |

(Continued)

FOREIGN PATENT DOCUMENTS

| | | | |
|---|---|---|---|
| CN | 1358657 | A | 7/2002 |
| EP | 1 785 776 | A1 | 5/2007 |
| JP | 62-100360 | A | 5/1987 |
| JP | 9-507716 | A | 8/1997 |
| JP | 10-218465 | A | 8/1998 |

OTHER PUBLICATIONS

International Preliminary Report on Patentability (IPRP) dated Jan. 20, 2011 in International Application No. PCT/JP2009/059549.

(Continued)

*Primary Examiner* — Negussie Worku
(74) *Attorney, Agent, or Firm* — Holtz, Holtz, Goodman & Chick, PC

(57) ABSTRACT

A stacking device includes a contact section with which top ends of the recording media in a conveying direction, conveyed into the storage space, make contact so stop the recording media at a storage position, a media move section which comprises a plurality of partition members, forms a plurality of spaces capable of storing the recording media between the partition members, stores the recording media stopped at the storage position into arbitrary one of the plurality of spaces, and moves the partition members thereby to move at least a part of the top ends of the recording media to a pushup position different from the storage position, and a lift section which pushes up, to the carry-out section, the recording media moved to the pushup position by the media move section.

20 Claims, 13 Drawing Sheets

U.S. PATENT DOCUMENTS

| | | | | |
|---|---|---|---|---|
| 6,717,286 | B2 * | 4/2004 | Tsuchiya et al. | 270/58.07 |
| 7,175,247 | B2 * | 2/2007 | Takenaka et al. | 347/14 |
| 7,436,419 | B2 * | 10/2008 | Ogawa | 347/214 |
| 7,613,422 | B2 | 11/2009 | Shida et al. | |
| 7,726,641 | B2 * | 6/2010 | Miyake et al. | 270/58.09 |
| 7,758,032 | B2 * | 7/2010 | Kawata et al. | 270/32 |
| 8,208,180 | B2 * | 6/2012 | Osakabe et al. | 358/474 |

OTHER PUBLICATIONS

International Search Report dated Aug. 25, 2009 (in English) in counterpart International Application No. PCT/JP2009/059549.
Chinese Office Action dated Oct. 10, 2012 (and English translation thereof) in counterpart Chinese Application No. 200980112272.8.

* cited by examiner

STACKING DEVICE AND IMAGE FORMING APPARATUS COMPRISING THE STACKING DEVICE

CROSS-REFERENCE TO RELATED APPLICATIONS

This is a Continuation Application of PCT Application No. PCT/JP2009/059549, filed May 25, 2009, which was published under PCT Article 21(2) in Japanese.

This application is based upon and claims the benefit of priority from prior Japanese Patent Application No. 2008-135895, filed May 23, 2008, the entire contents of which are incorporated herein by reference.

BACKGROUND OF THE INVENTION

1. Field of the Invention

The present invention relates to a stacking device, which stores recording media with images formed thereon and delivers the recording media to a post-processing machine so as to stack the media, and also relates to an image forming apparatus comprising the stacking device.

2. Description of the Related Art

An image forming apparatus is provided with a stacking device which delivers recording media with images formed thereon, to a post-processing machine. The post-processing machine performs, for example, a shifting process, a punching process, a binding process, a gluing process, etc.

For example, Jpn. PCT National Publication No. 9-507716 discloses an intermediate storage section comprising a plurality of partial storage units for temporarily stored recording media on which images have been formed by a printer. The intermediate storage section is connected to a job finishing device. Further, recording media are taken out of the plurality of partial storage units, and managed by the job finishing device in accordance with a document.

BRIEF SUMMARY OF THE INVENTION

According to an embodiment of the present invention, there is provided a stacking device comprising a carry-out section which stores a plurality of sheets of recording media conveyed in from a carry-in section, into a storage space formed along vertical directions, and delivers the stored plurality of recording media to a device for a later process, the stacking device further comprising: a contact section with which top ends of the recording media in a conveying direction, conveyed into the storage space, make contact to stop the recording media at a storage position; a media move section which comprises a plurality of partition members, forms a plurality of spaces capable of storing the recording media between the partition members, stores the recording media stopped at the storage positron into arbitrary one of the plurality of spaces, and moves the partition members thereby to move at least a part of the top ends of the recording media to a pushup position different from the storage position; and a lift section which pushes up, to the carry-out section, the recording media moved to the pushup position by the media move section.

Additionally, an embodiment of the present invention provided an image forming apparatus comprising: a supply section which supplies a long continuous recording medium; an image forming section which performs image forming on the continuous recording medium; a cutter section which cuts the continuous recording medium recorded by the image forming section, into recording media each having a predetermined size; a media conveyor section which conveys the continuous recording medium from the supply section to the cutter section; a stacking device which is provided below the cutter section, performs a stacking process of stacking the cut recording media, and delivers the recording media stacked, to a device for a later process; and a controller which controls at least the supply section, the image forming section, the cutter section, the media conveyor section, and the stacking device, wherein the stacking device comprises a carry-in section which conveys the recording media cut by the cutter section, into a storage space formed along vertical directions, a carry-out section which delivers the recording media in a plurality stored in the storage space, to the device for the late process, a contact section with which top ends of the recording media in a conveying direction, conveyed into the storage space, make contact to stop the recording media at a storage position, a media move section which comprises a plurality of partition members, forms a plurality of spaces capable of storing the recording media between the partition members, stores the recording media stopped at the storage position into arbitrary one of the plurality of spaces, and moves the partition members thereby to move at least a part of the top ends of the recording media to a pushup position different from the storage position, and a lift section which pushes up, to the carry-out section, the recording media moved to the pushup position by the media move section.

Advantages of the invention will be set forth in the description which follows, and in part will be obvious from the description, or may be learned by practice of the invention. Advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Hereinafter, an embodiment of the present invention will be specifically described with reference to the drawings.

Figure 1A:
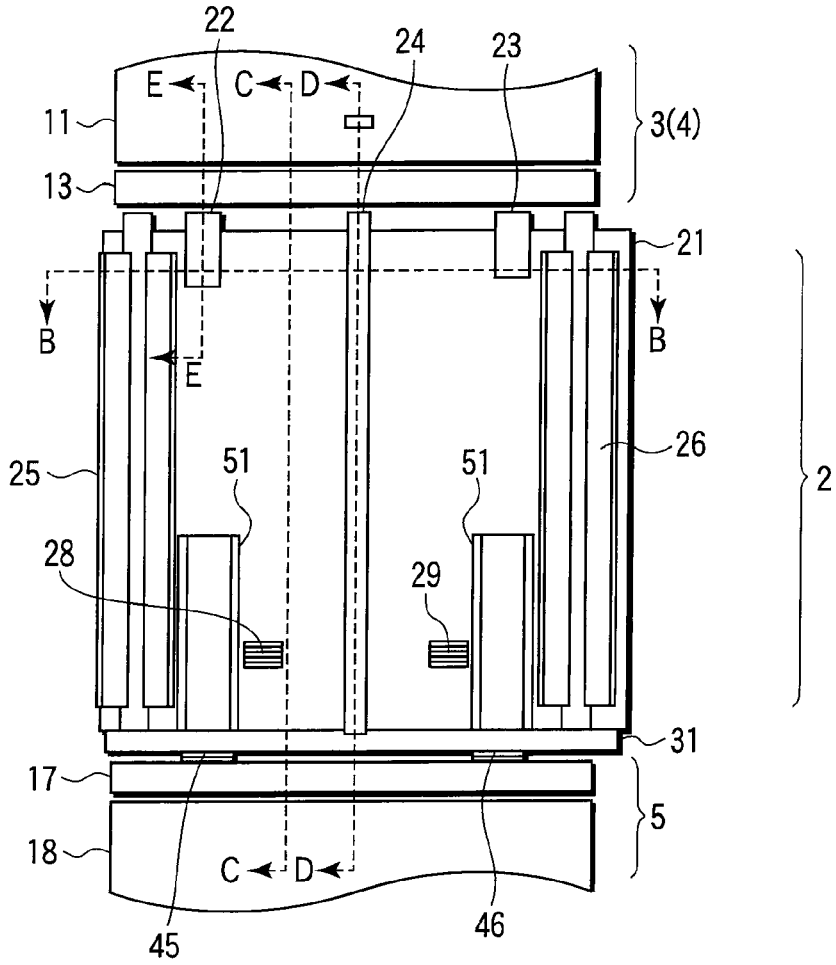
FIG. 1A is a block diagram in which a stacking device according to an embodiment of the invention is viewed from a front side.
Figure 1B:
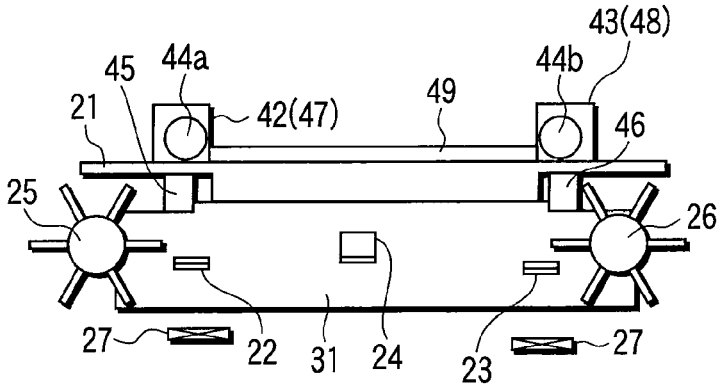
FIG. 1B is a block diagram of the stacking device viewed from a top, cut along line B-B in FIG. 1A.
Figure 1C:
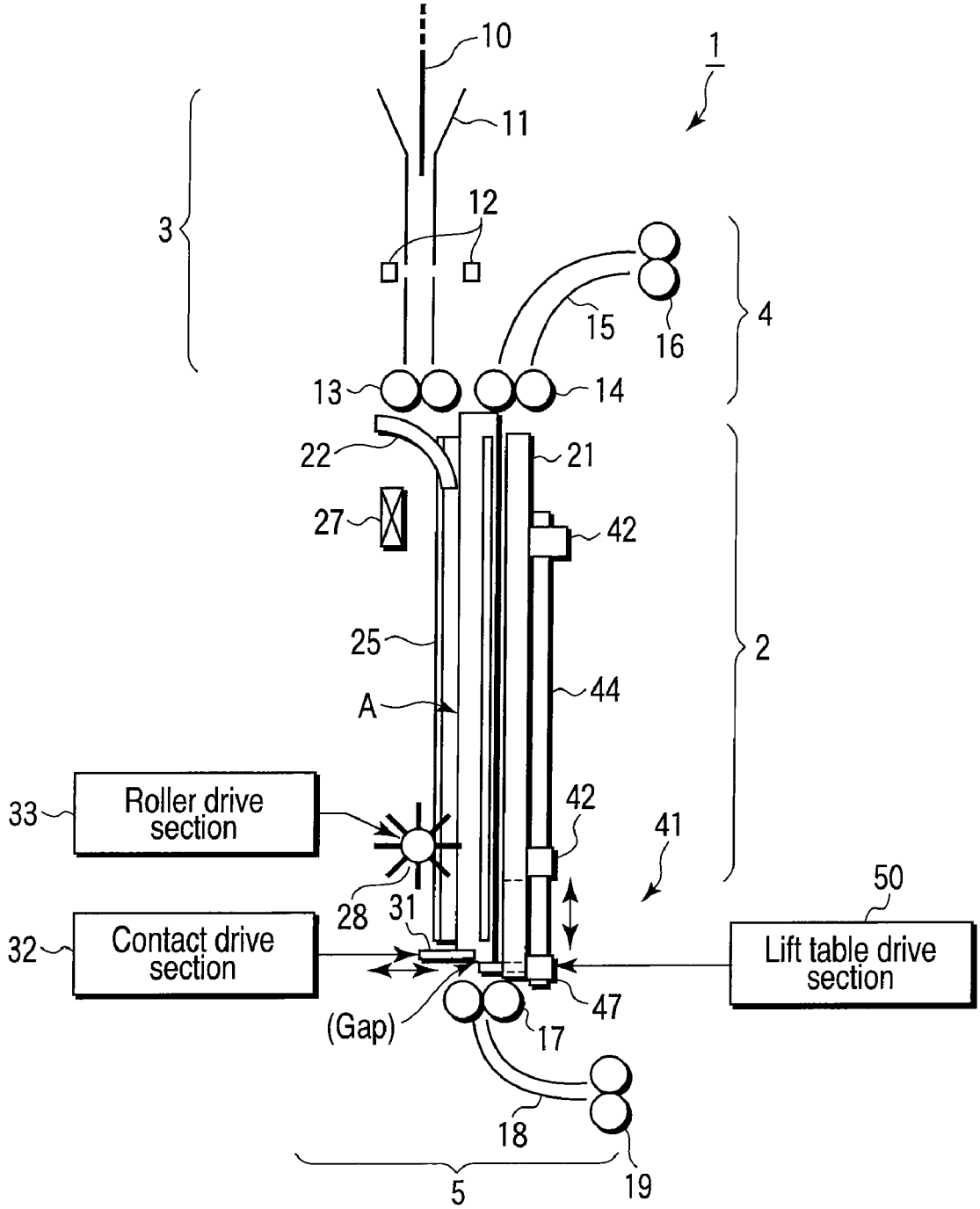
FIG. 1C is a block diagram of the stacking device viewed from a side, cut along line C-C in FIG. 1A.
Figure 1D:
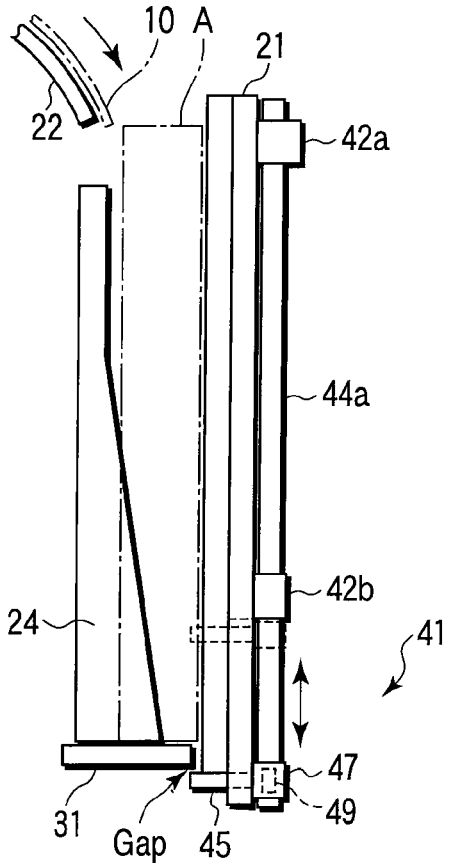
FIG. 1D is a block diagram of the stacking device viewed from a side, cut along line D-D in FIG. 1A.
Figure 1E:
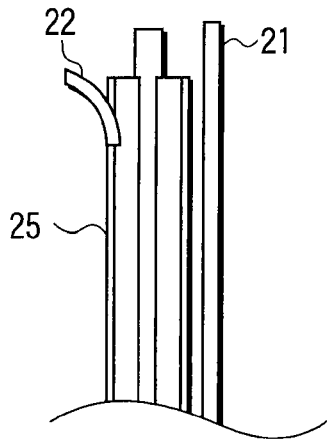
FIG. 1E is a block diagram of the stacking device viewed from a side, cut along line E-E in FIG. 1A.

FIGS. 1A, 1B, 1C, 1D and 1E illustrates an exterior configuration of a stacking device which temporarily stores a plurality of recording media and delivers the media to a post-processing machine. FIG. 1A is a view illustrating a configuration of the stacking device, viewed from a front of the stacking device. FIG. 1B is a view illustrating a configuration of the stacking device viewed from a top, cut along line B-B in FIG. 1A. FIG. 1C is a view illustrating a configuration of the stacking device viewed from a side, cut along line C-C in FIG. 1A. FIG. 1D is a view illustrating a configuration of the stacking device viewed from a side, cut along line D-D in FIG. 1A. FIG. 1E is a view illustrating a configuration of the stacking device viewed from a side, cut along line E-E in FIG. 1A.

The stacking device according to the invention temporarily stores sheet-type recording media which are ejected sequentially from a eject port of an image forming apparatus, with the recording media bent in a direction perpendicular to a conveying direction so as to tension the recording media. After thus storing a prespecified number of recording media, the stacking device delivers the stacked and aligned recording media to the post-processing machine provided for a later process, maintaining a state for receiving new recording media. For example, when rectangular recording media each having major and minor edges are conveyed in a direction along the major edges, the minor edges perpendicular to the conveying direction are bent to be round or two ends thereof are bent so as not to be too sharp.

The image forming apparatus may be a printer represented primarily by an inkjet printer, or a copying machine. Further, recording media may be conveyed into the stacking device which performs a stacking process, from the image forming apparatus, or conveyed into a sorter mechanism attached to the image forming apparatus. The post-processing machine is, for example, a device which performs a shifting process, a punching process, a binding process, a gluing process, etc.

A stacking device 1 is constituted by a device body section 2, a recording-media carry-in section 3, a recording-media carry-out section 4, and a recording-media disposal section 5. The stacking device 1 comprises an unillustrated controller which controls the device body section 2, recording-media carry-in section 3, recording-media carry-out section 4, and recording-media disposal section 5.

The recording-media carry-in section 3 is constituted by an inlet guide 11, a media detector 12, and paired inlet rollers 13. The inlet guide 11 guides sheet-type recording media 10 to convey in. The media detector 12 detects recording media 10 passing the inlet guide 11. The paired inlet rollers 13 are to convey the recording medium 10 into the device body section 2 described later.

The rotational speed of the paired inlet rollers 13 is set so as to elongate an interval between one another of recording media which are sequentially conveyed in. That is, a speed at which a recording medium is conveyed out by the paired inlet rollers 13 is set to be greater than a speed at which a recording medium is conveyed into the paired inlet rollers 13. At the media detector 12, a light emitting section and a light receiving section are provided to face each other in a manner that an opening provided in the inlet guide 11 is interposed therebetween. When a recording medium passes the media detector 12, the media detector 12 detects the recording medium from a top end to a rear end thereof since the recording medium shields light from the light emitting section.

The recording-media carry-out section 4 is constituted by paired pickup rollers 14, a carry-out guide 15, and paired carry-out rollers 16. The paired pickup rollers 14 pick up stacked and aligned recording media lifted by a lift section 41. The carry-out guide 15 and the paired carry-out rollers 16 are to convey out recording media to the post-processing machine provided for a later process. The paired pickup rollers 14 and paired carry-out rollers 16 each may appropriately comprise a one-way clutch.

As illustrated in FIG. 1C, the recording-media disposal section 5 is constituted by paired eject rollers 17, a disposal, guide 18, and paired disposal rollers 19. The paired eject rollers 17 are to pull out an unwanted recording medium when a sheet contact section 31 described later is positioned at a retracted position (or a non-contact position). The disposal guide 18 and paired disposal rollers 19 are to eject recording media to a disposal tray 20 (see FIG. 3D).

A contact drive section 32 opens/closes the sheet contact section 31 at a timing based on a detection signal from the media detector 12. Now, a non-contact position is defined to be a state in which the sheet contact section 31 is opened. At this non-contact position, an unwanted recording medium is conveyed to the recording-media disposal section 5. In other words, when the sheet contact section 31 is at the non-contact position, recording media are out of contact with the sheet contact section 31. Otherwise, a storage position (or contact position) is defined to be a state in which the sheet contact section 31 is closed. At this contact position, recording media to be stored make contact with the sheet contact section 31 in a storage space (hereinafter referred to as a storage space A) in the device body section 2 denoted at reference symbol A in FIG. 1C, and are stored in the storage position. Even recording media which have once been stored in the storage space A can be ejected by moving the sheet contact section 31 to the non-contact position, pushing down the paddle rollers 28 and 29 described later, and further pulling out the recording media by the paired eject rollers 17.

In each of the paired rollers described above, at least one roller is a drive roller and the other one is a driven roller. Although no drive source for any drive roller is illustrated, a known motor and a transmission mechanism, such as gears and/or a belt, are used.

The device body section 2 conveys out unwanted ones of the recording media 10 having a defined size, to the recording-media disposal section 5. The device body section 2 stores a plurality of recording media together to be delivered to the post-processing machine, and convey the plurality of recording media to the recording-media carry-out section 4, with the plurality of recording media stacked and aligned (in a stacked state).

Roughly divided, the device body section 2 is constituted by a base member 21, carry-in guide sections 22 and 23, a tension guide section 24 which tensions the recording media (to be firm), impellers 25 and 26, a fan 27, paddle rollers 28 and 29, a sheet contact section 31, and a lift section 41.

As illustrated in FIG. 1B, the base member 21 has a rectangular shape and is made of a hard material such as metal. Viewed from upside (in a direction of conveying in recording media), the base member 21 has a convex shape in which two ends of a surface thereof are thinned by one step. The impellers 25 and 26 are provided at positions where the impellers 25 and 26 face the thinned surface. A side (non-installation side) of the base member 21 where the impellers 25 and 26 are not provided is referred to as a back surface. An unillustrated back plate is provided at a position where the back plate faces the base member 21 with the impellers 25 and 26 interposed therebetween. The back plate is provided to be openable/closable so as to allow the recording medium 10 to be taken out when there is jamming. The storage space A for storing recording media is formed by the impellers 25 and 26, base member 21, and back plate.

As illustrated in FIG. 1A, this back plate is provided with the carry-in guide sections 22 and 23, tension guide section 24, fan 27, and paddle rollers 28 and 29.

The carry-in guide sections 22 and 23 are provided between the impellers 25 and 26 in a side of the paired inlet rollers 13. As illustrated in FIG. IE, an angle of the carry-in guide section 22 is adjusted in a manner that a top end of the recording medium 10 to be conveyed in are positioned between blades of the impeller 25. The same thing applies to the carry-in guide section 23.

The carry-in guide sections 22 and 23 are provided in order to inhibit upper ends (rear ends in the conveying direction) of recording media 10 stored previously in a posture described later, from colliding with a top end of a recording medium to be conveyed subsequently in the conveying direction, when recording media 10 are stored sequentially. The carry-in guide sections 22 and 23 each are formed to have a curved surface (collision surface) made of metal which is slippery for the recording media 10 or made of hard resin. Alternatively, the carry-in guide sections 22 and 23 may be supported on a back surface (a non-collision surface) thereof to be floated by an elastic member such as a spring, so as to absorb rebound of the top ends of the recording media 10 when the top ends collide with the carry-in guide sections 22 and 23.

As illustrated in FIG. 1D, the tension guide section 24 has a shape whose lower end (bottom edge side) spreads more widely than an upper end thereof (inlet port side) toward the base member 21. In this manner, the tension guide section 24 bends two side ends at least in the top end side of the recording media 19 toward the back plate side. In other words, the tension guide section 24 bends the top ends of the recording media 10 such that a normal to a surface of each recording medium, which makes contact with the sheet contact section 3, becomes a center of curvature. Thus, since the recording media 10 are deformed and shaped to stand up by bending the recording media 10, the recording media 10 are tensioned to be firm. The recording media 10 are thus postured so as to hardly bend in vertical directions. When conveying in the recording media 10, the top ends of the recording media 10 shaped in this posture collide with the sheet contact section 31, and the recording media 10 are thus stored. FIG. 4B illustrates a state in which a recording medium 10 is stored.

The fans 27 as an air blower are provided near the carry-in guide sections 22 and 23. The fans 27 send air to stored recording media, thereby pushing the recording media 10 to the base member 21. That is, the fans 27 serve a function to create a gap between the stored recording media 10 and the carry-in guide sections 22 and 23, and to prevent a top end of a recording medium 10 being conveyed through the carry-in guide sections 22 and 23 from making contact with rear ends of stored recording media 10. Therefore, the fans 27 may be provided upon necessity.

The paddle rollers 28 and 29 as a conveyor assist mechanism are provided respectively in two sides of the tension guide section 24. The paddle rollers 28 and 29 have soft blade parts which are made of, for example, rubber or resin. The paddle rollers 28 and 29 are a conveyor assist mechanism which conveys a recording medium 10 to a further downstream side when the recording medium 10 comes to receive no conveying force any more while the recording medium 10 is being stored (e.g., when a rear end of the recording medium is moved to a downstream side of the paired inlet rollers 13). Further, the paddle rollers 28 and 29 are controlled to be driven by a roller drive section 33, and rotate at the same rotational speed as the paired inlet rollers 13.

Each of the impellers 25 and 26 as a media move section is configured by uniformly attaching a plurality of blades to a cylindrical axle provided to extend in vertical directions (or in the conveying direction). In this manner, a plurality of spaces are created between the blades. In the present embodiment, six blades are provided. The plurality of blades are formed of an elastic member, such as metal, resin, or hard rubber, for example. Accordingly, even if a top end part of the blades makes contact with the surface of the base member 21 when the impellers 25 and 26 rotate, the top end can pass through as the top end slightly flexibly bends. After the top end passes, the blades recover an original shape.

The conveyed recording medium 10 is guided by the carry-in guide sections 22 and 23, and is stored in a manner that two sides of the recording medium 10 falls respectively between the blades of the impeller 25 and between those of the impeller 26. Although the present embodiment exemplifies impellers each comprising six blades, the number of blades is not limited to six.

The impellers 25 and 26 rotate at the time of delivery to the post-processing machine, as described later, and bend (press), toward the base member 21, two sides of one or a plurality of stacked and aligned recording media 10 in a top end side, which are stored in one space of the plurality of spaces created between blades. By this press, the two sides of the recording media 10 in the top end side are moved from the sheet contact section 31 to a side or lift tables 45 and 46. In other words, by rotating the impellers 25 and 26, at least one of parts of the stored recording media which are in contact with the sheet contact section 31 is moved to a position (pushup position) where the recording media are out of contact with the sheet contact section 31. By this pressing, the recording media 10 are stored with center parts of the recording media 10 bent by a convex part of the base member 21, where viewed from upside. This bending is performed in a direction opposite to bending by the tension guide section 24.

Immediately thereafter, a first recording medium is conveyed in from among a next stacked group. At this time, the conveyed recording medium is stored between different blades from those described above.

The sheet contact section 31 forms a plate-like shape, and aligns top ends of recording media 10 fed by the paddle rollers 28 and 29 by bringing the top ends into contact with a plate surface. At this time, as described above, the recording medium 10 is tensioned to be firm by bending. A position where the recording medium 10 collides with and is brought into contact with the sheet contact section 31 is referred to as the storage position.

Figure 3A:
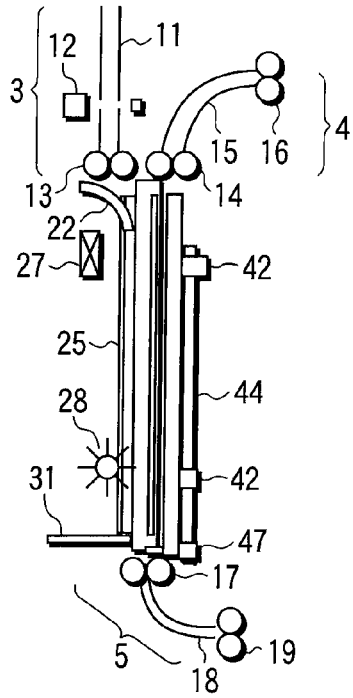
FIG. 3A illustrates a state of a disposal process for disposing of an unwanted recording medium in the stacking device when the device is started or stopped.
Figure 3B:
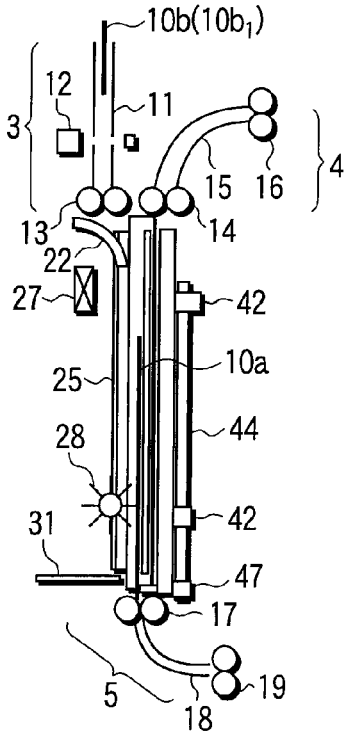
FIG. 3B illustrates a state of the disposal process for disposing of an unwanted recording medium, in which a sheet contact section is started to move to a storage position at a timing when a top end of a last unwanted recording medium is nipped by paired eject rollers.
Figure 3C:
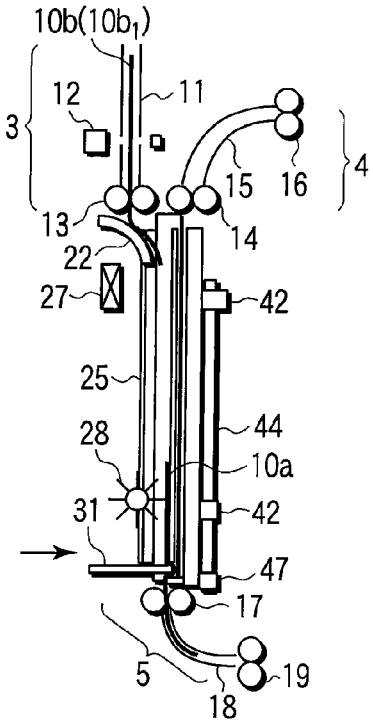
FIG. 3C illustrates a state of the disposal process for disposing of an unwanted recording medium, in which the sheet contact section is positioned at the storage position.

The sheet contact section 31 is moved (reciprocally moved in a direction horizontal to an installation surface) by the contact drive section 32. When the device is stopped and started, the sheet contact section 31 is located at a non-contact position as illustrated in FIG. 3A described later. When storing a recording medium, the sheet contact section 31 is located at a contact position, as illustrated in FIG. 3C described later.

A recording medium which is conveyed in when the sheet contact section 31 is at the non-contact position does not make contact with the sheet contact section 31 but is directly guided to the paired eject rollers 17. A procedure of disposing of an unwanted recording medium will be described later. Otherwise, when an instruction to deliver stacked recording media to the post-processing machine for a later process is given from the controller, the sheet contact section 31 is moved to the contact position by the contact drive section 32. At this contact position, the sheet contact section 31 makes contact with the conveyed recording media 10 and stores the plurality of recording media 10 together at the storage position.

The sheet contact section 31 may have elasticity in a direction toward the contact position. The elasticity acts to an extent that eject of a recording medium is not obstructed when the sheet contact section 31 makes contact with an unwanted recording medium being ejected for disposal. The sheet contact section 31 may be formed in a convex shape by recessing parts where the lift tables 45 and 46 are provided.

Next, a configuration of the lift section 41 will be described.

As illustrated in FIGS. 1A, 1B, 1C and 1D, the lift section 41 is constituted by fixing/support members 42 (42*a* and 42*b*) and 43 (43*a* and 43*b*), two guide axles 44 (44*a* and 44*b*), lift tables 45 and 46, support members 47 and 48, and a link member 49.

The fixing/support members 42 (42*a* and 42*b*) and 43 (43*a* and 43*b*) fix the guide axles 44 (44*a* and 44*b*) to a back surface of the base member 21. The guide axles 44 (44*a* and 44*b*) are provided to extend in vertical directions (upward/downward direction) in a side of the back surface (a surface where the impellers 25 and 26 are not provided). The lift, tables 45 and 46 are attached to the guide axles 44 (44*a* and 44*b*) by the support members 47 and 48. Recording media are placed on the lift tables 45 and 46, which deliver the placed recording media to the recording-media carry-out section 4. The support members 47 and 48 support the lift tables 45 and 46 to be movable along the guide axles 44. Further, the link member 49 connects the support members 47 and 48 to each other. Notches 51 are provided in the base member 21 so as to allow the lift tables 45 and 46 to be raised and lowered.

Figure 2:
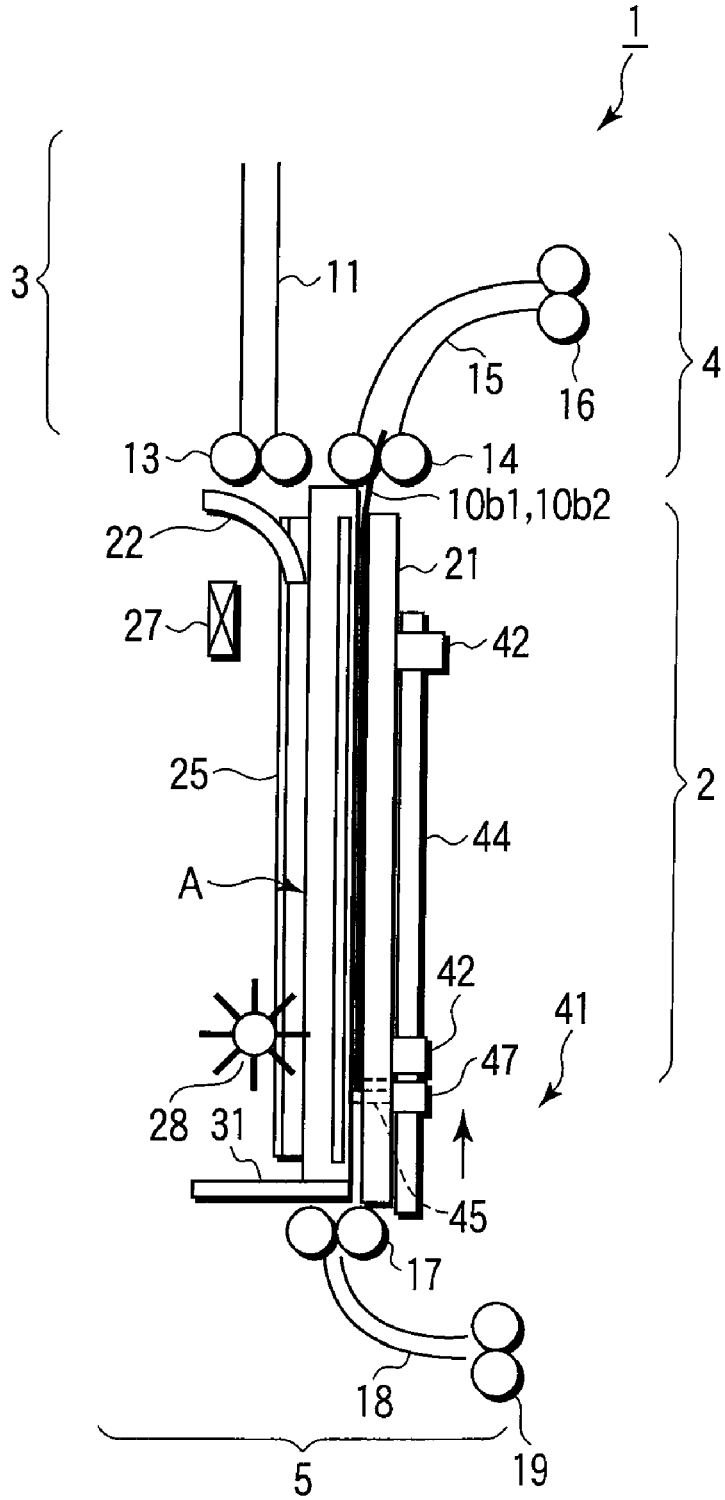
FIG. 2 illustrates a state in which stacked and aligned recording media are pushed up by raising lift tables.

FIG. 2 illustrates a state in which the lift tables 45 and 46 are pushed up in order to deliver stacked and aligned recording media to the recording-media carry-out section 4. A position in which the lift tables 45 and 46 are positioned as illustrated in FIG. 1C is referred to as a first position (a down position). Another position in which the lift tables 45 and 46 are positioned as illustrated in FIG. 2 is referred to as a second position (an up position).

As illustrated in FIG. 2, the lift tables 45 and 46 are simultaneously driven to the second, position along the guide axles 44*a* and 44*b* by a lift table drive section 50. Then, recording media 10 which are pushed up make contact with the paired pickup rollers 14 which are rotating. The recording media 10 are nipped by the paired pickup rollers 34, picked out by the carry-out guide 15, and conveyed by the paired carry-out rollers 16. Thus, the recording media 10 which are stacked and pushed up are delivered to the recording-media carry-out section 4.

To raise and lower the lift tables 45 and 46, various known drive mechanisms may be employed, such as a drive mechanism using a ball screw, a cylinder mechanism using oil or air, a drive mechanism using pulleys and a wire, or a drive mechanism using a magnet (e.g., a linear motor).

When the lift tables 45 and 46 are at the down position, the lift tables 45 and 46 are set to be positioned lower than the sheet contact section 31 in a manner that a gap which allows recording media to pass through is formed between a lower surface of the sheet contact section 31 and upper surfaces of the lift tables 45 and 46. At this time, the lift tables 45 and 46 are also positioned such that the lift tables 45 and 46 do not make contact with the sheet contact section 31 even when the lift tables 45 and 46 are pushed up.

Figure 5A:
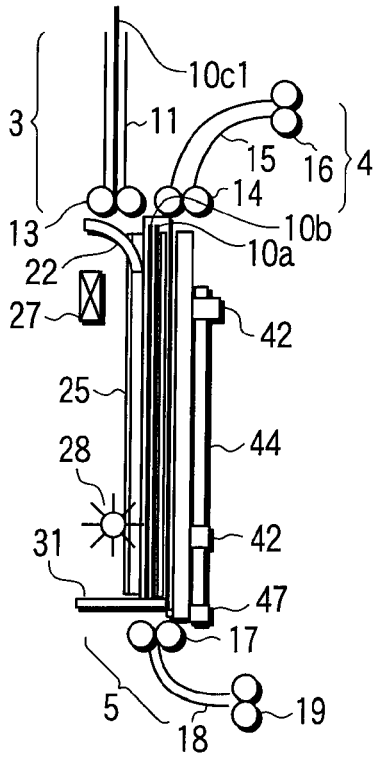
FIG. 5A is a side view illustrating a state in which a second recording medium is stored in the stacking device.
Figure 6:
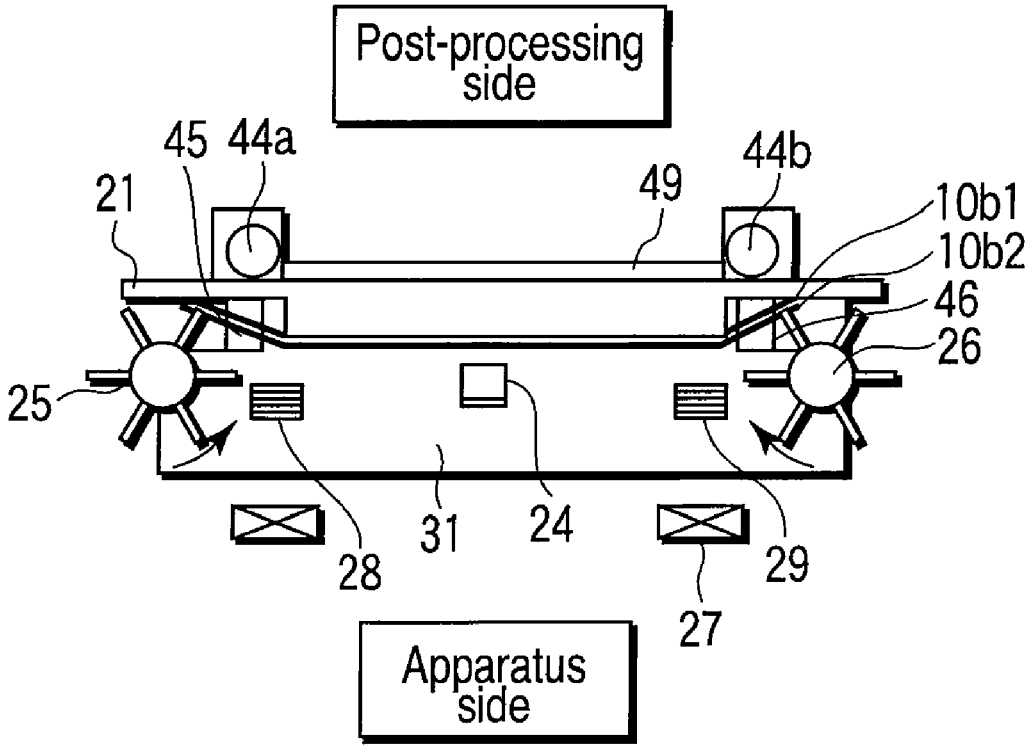
FIG. 6 illustrates a state in which impellers are rotated.
Figure 7A:
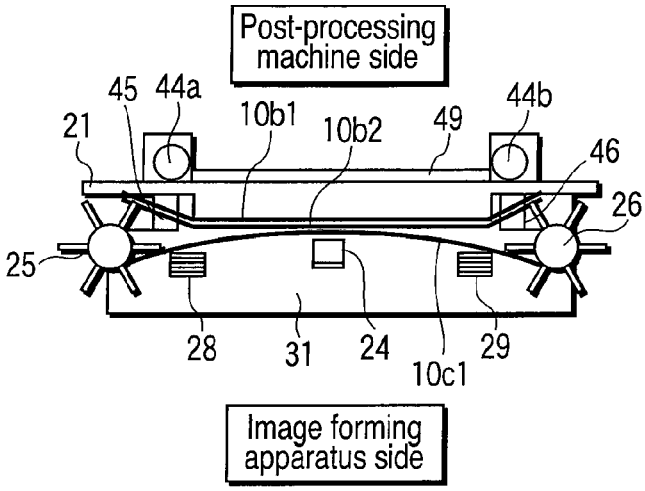
FIG. 7A is a top view illustrating a state in which recording media are conveyed in and out.
Figure 7B:
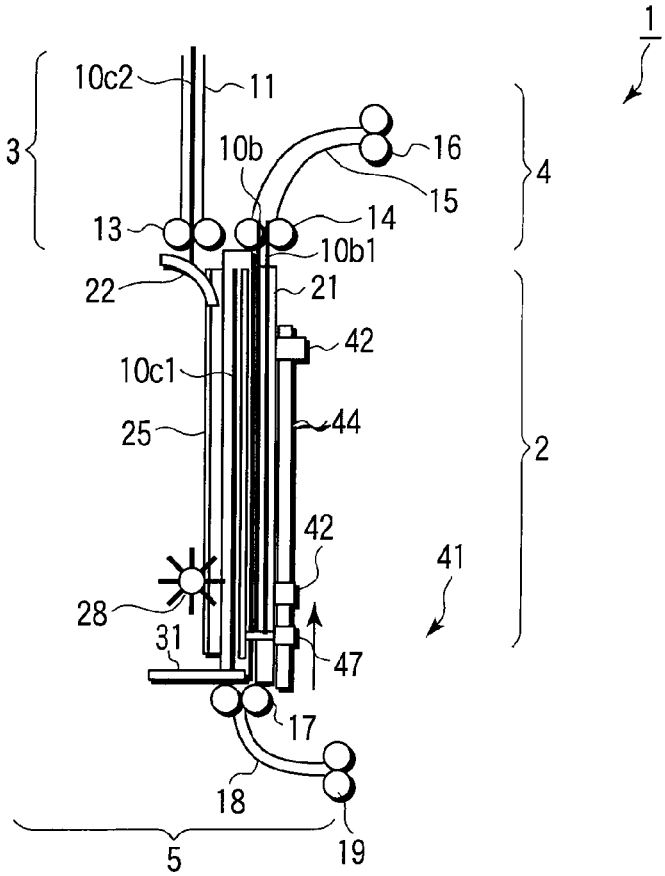
FIG. 7B is a side view illustrating a state in which recording media are conveyed in and out.
Figure 8:
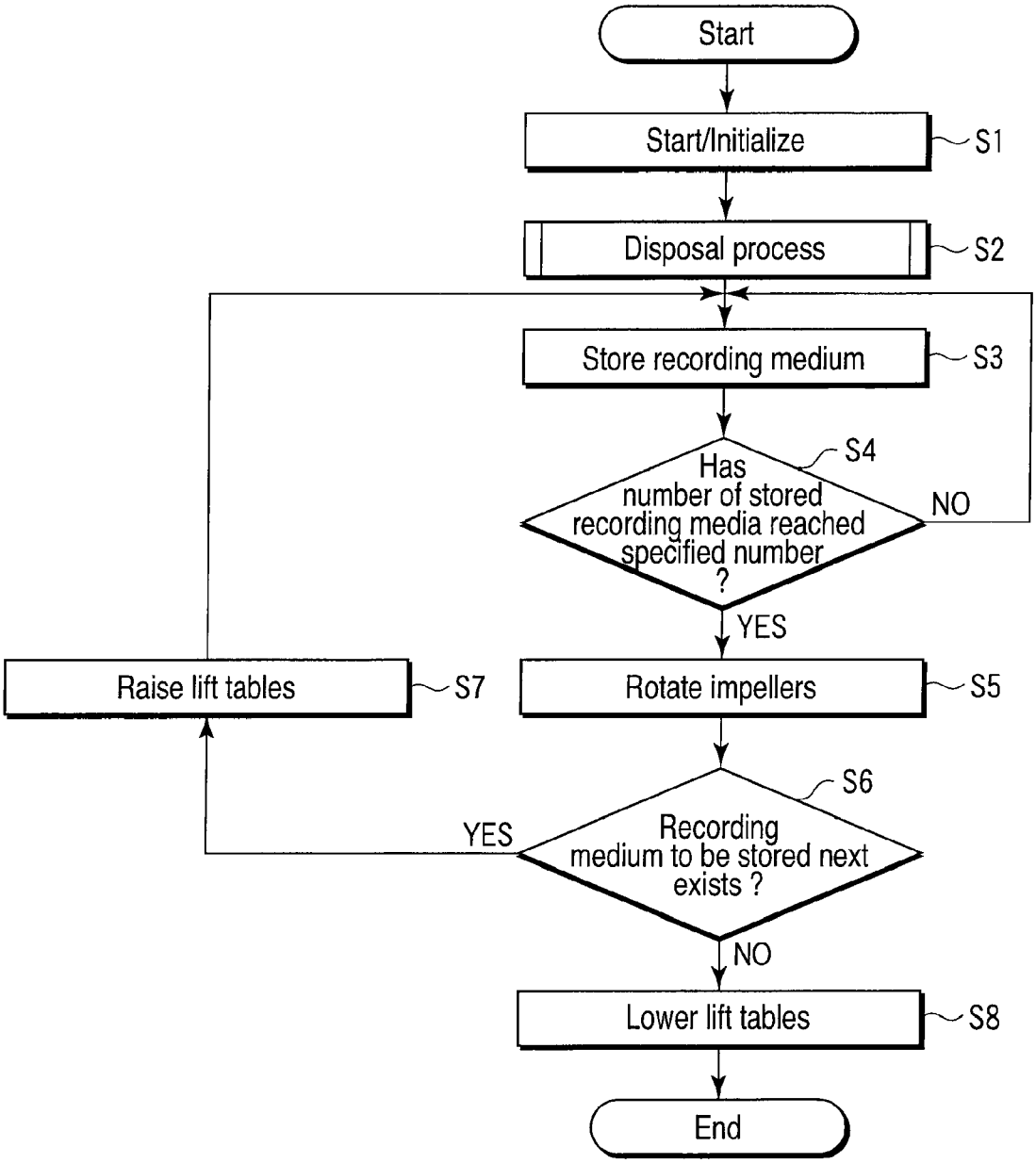
FIG. 8 is a flowchart for describing a stacking process by the stacking device.

Next, a stacking process of the stacking device 1 configured as described above will be described with reference to a flowchart in FIG. 8. In descriptions below, FIG. 2 illustrates a state in which stacked and aligned recording media are pushed up to be delivered. FIGS. 3A, 3B, 3C and 3D illustrate states of a disposal process for unwanted recording media. FIGS. 4A, 4B, 5A and 5B illustrate states of storing recording media. FIG. 6 illustrates a state when the impellers rotate. FIGS. 7A and 7B illustrates a state in which stored recording media are moved to the lift tables and delivered and a next recording medium is simultaneously stored.

At first, the device is started and initialized by turning on a main power supply (step S1). At this time, the other image forming apparatus and the post-processing machine are also started. In place of starting the devices individually, the stacking device and post-processing machine may be configured to be started together when the image forming apparatus is started up.

In initialization, whether the sheet, contact section 31 is positioned at the non-contact position or not and whether the lift tables 45 and 46 are positioned at the down position or not are checked. If the sheer contact section and the lift tables are not positioned respectively at the non-contact position and the down position, the sheet contact section and the lift tables are respectively moved to the contact position and the down position. Further, driving of each of constitutive sections is started.

Figure 9:
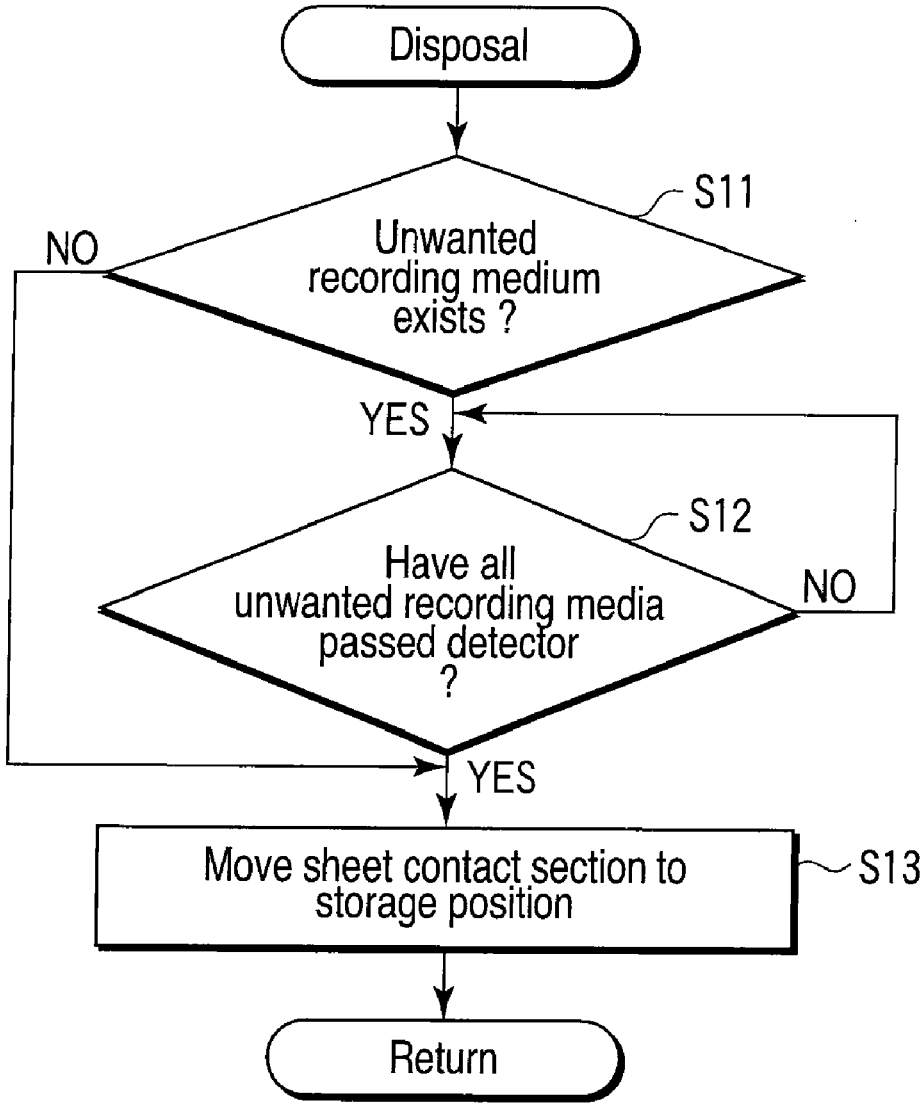
FIG. 9 is a flowchart for describing a disposal process for an unwanted recording medium, in the stacking process.

Next, the disposal process for unwanted recording media is performed (step S2). The disposal process will be described with reference to the flowchart of FIG. 9 and to FIGS. 3A to 2D.

FIG. 3A illustrates a state when the device is started or stopped. At this time, the sheet contact section 31 is located at the non-contact position. In this state, whether an unwanted recording medium (hereinafter an unwanted recording medium will be referred to as an unwanted medium 10*a*) is fed to the stacking device 1 or not is checked (step S11). This check is made depending on a notification to the controller of the stacking device 1 from an apparatus connected to the stacking device 1, i.e., from the controller of the image forming apparatus. That is, the controller of the image formation apparatus notifies of information concerning whether there is any unwanted medium 10*a* or not and, if any, how many unwanted media 10*a* exist.

In this manner, if step S11 determines that there is any unwanted medium 10*a* (YES), whether all unwanted media 10*a* have passed through the media detector 12 or not is monitored (step S12). Otherwise, if not all unwanted media 10*a* have passed yet (NO), monitoring is continued until all unwanted media 10*a* have passed.

Otherwise, if the media detector 12 detects a rear end of a last unwanted medium 10*a* in the conveying direction (YES), the sheet contact section 31 is moved to the contact position after elapse of a predetermined time period (step S13). Specifically, as illustrated in FIG. 3B, the sheet contact section 31 is started to move to at a timing of nipping a top end of the last unwanted medium 10*a* in the conveying direction. Further, as illustrated in FIG. 3C, the sheet contact section 31 is positioned at the contact position.

Figure 3D:
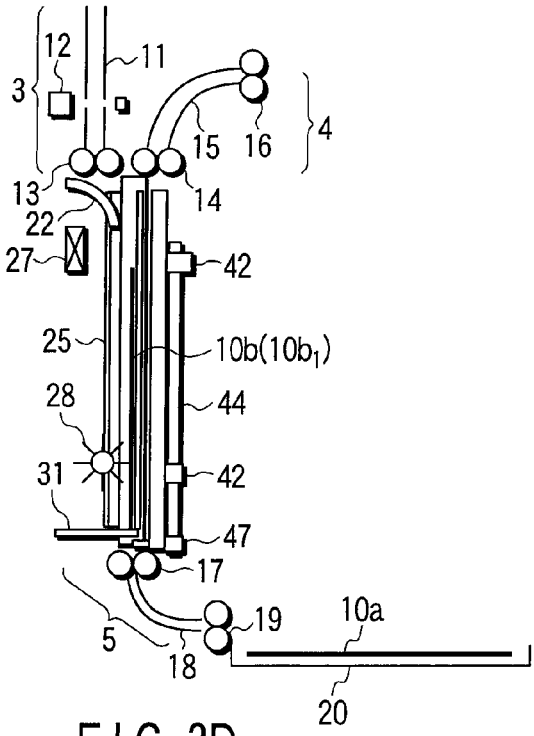
FIG. 3D illustrates a state of the disposal process for disposing of an unwanted recording medium, in which the unwanted recording medium is ejected onto a disposal tray.

In the middle of moving the sheet contact section 31 to the contact position, the sheet contact section 31 makes contact with the unwanted medium 10*a*. However, the sheet contact section 31 and lift tables 45 and 46 are configured to creating a gap as described previously. Therefore, the unwanted medium 10*a* is conveyed through the gap by a conveying force of the paired carry-out rollers 16. Further, as illustrated in FIG. 3D, the unwanted medium 10*a* is ejected to the disposal tray 20 by the disposal guide 18 and paired disposal rollers 19.

Thus, before the last unwanted medium 10*a* is stored into the disposal tray 20, the sheet contact section 31 is started to move to the contact position. In this manner, for example, as illustrated in FIG. 3B, even if a recording medium to be stored immediately after the last, unwanted medium 10*a* (hereinafter referred to as a recording medium to be stored 10*b*) is conveyed in, a top end of the recording medium to be stored 10*b* can be securely stored on the sheet contact section 31.

Otherwise, if step S11 determines that there is no unwanted medium 10*a* (No), processing goes to step S13, and the sheet contact section 31 is moved to the contact position. The disposal process is then ended and returns.

Next, recording media to be stored 10*b* which are conveyed in for the stacking process are sequentially brought into contact with the sheet contact section 31 and stored into the storage position (step S3). Further, whether a specified number of recording media to be stored 10*b* have been stored or not is determined by the media detector 12 (step S4). The number of recording media to be stored 10*b* to be stored in the stacking device 1 is included in the information which the controller of the stacking device 1 has been notified of from the controller of the image forming apparatus in the disposal process described previously. The present embodiment is supposed to store two recording media to be stored 10*b* (10*b* and 10*b*2).

A first recording medium, to be stored 10*b*1 conveyed in from the inlet guide 11 passes the media detector 12 and reaches the paired inlet rollers 13. The media detector 12 detects top and rear ends of the recording medium to be stored 10*b*1, and counts the number of recording media to be stored passing. The recording medium to be stored 10*b*1 is conveyed in between blades of the impellers 23 and 26 through the carry-in guide sections 22 and 23. At this time, the rear end of the recording medium to be stored 10*b*1 goes out of the paired inlet rollers 13. However, the recording medium to be stored 10*b*1 is pulled down by the paddle rollers 28 and 29 and brought into contact with the sheet contact section 31, to be stored there. At this time, the recording medium to be stored 10*b*1 is conveyed, guided by the tension guide section 24.

Figure 4A:
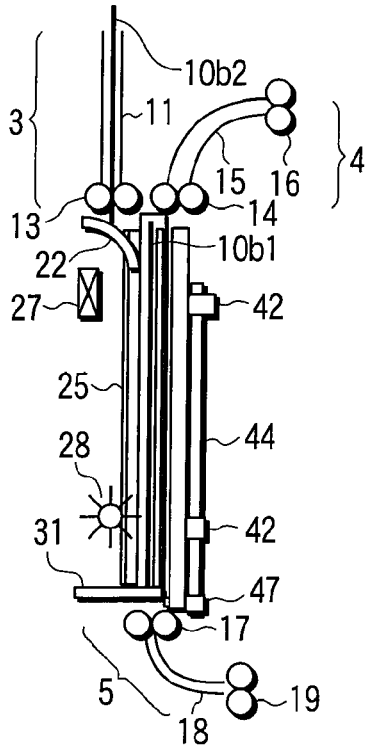
FIG. 4A is a side view illustrating a state in which a first recording medium is stored in the stacking device.
Figure 4B:
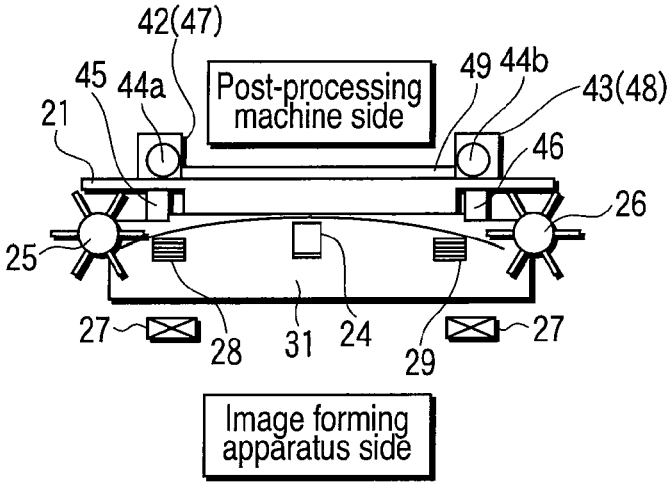
FIG. 4B is a top view illustrating a state in which the first recording medium is stored in the stacking device.

FIGS. 4A and 4B illustrate a stored state of the recording medium to be stored 10*b*1. As illustrated in FIG. 4B, the recording medium to be stored 10*b*1 is bent by the tension guide section 24 to be firm. Specifically, the tension guide section 24 bends a top end of the recording medium to be stored 10*b* in a manner that a normal to a surface of the sheet contact section 31, which makes contact with the recording medium to be stored 10*b*1, becomes a center of curvature.

In this manner, as illustrated in FIG. 4A, the recording medium to be stored 10*b*1 is shaped to stand straight up, and is postured so as to hardly bend in vertical directions.

In addition, air is sent to the recording medium to be stored 10*b*1 by the fans 27. Therefore, a gap is created between the rear end of the recording medium to be stored 10*b*1 and the carry-in guide sections 22 and 23. In this state, a subsequent second recording medium to be stored 10*b*2 is conveyed in between blades of the impellers 25 and 26 through the carry-in guide sections 22 and 23. At this time, a top end of the recording medium to be stored 10*b*2 makes contact with a surface part of the recording medium to be stored 10*b*1, and does therefore not cause jamming. Accordingly, as illustrated in 5B, a specified number of recording media to be stored are stored.

In step S4, if the number of stored media reaches the specified number (YES), the impellers 25 and 26 are rotated with the recording media to be stored 10*b*1 and 10*b*2 stored and aligned. Further, two side ends of each other the recording media to be stored 10*b*1 and 10*b*2 are moved from the sheet contact section 31 to the lift tables 45 and 46 (step S5). Otherwise, if the number of stored media does not yet reach the specified number (No), further recording media to be stored are continuously stored.

In step S5, a timing to rotate the impellers 25 and 26 is elapse of a predetermined time period from detection of the recording medium to be stored 10*b*2 by the media detector 12. That is, at the timing when the recording media to be stored 10*b*1 and 10*b*2 are set on the sheet contact section 31, the impellers 25 and 26 rotate. FIG. 6 illustrates a state in which the impellers 25 and 26 rotate.

Figure 5B:
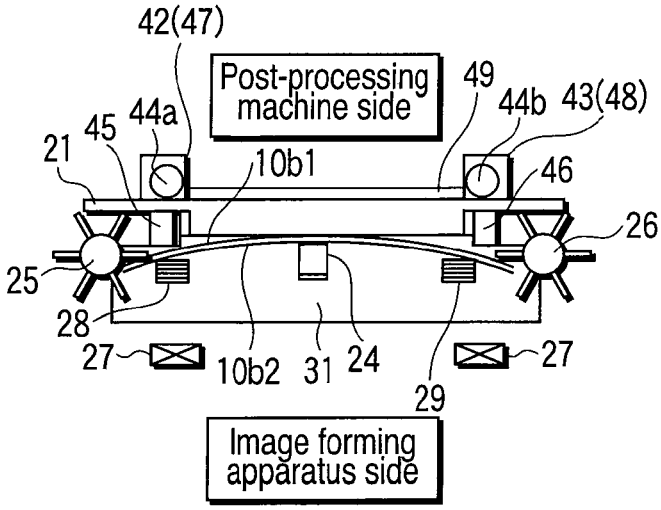
FIG. 5B is a top view illustrating a state in which a second recording medium is stored in the stacking device.

The impellers 25 and 26 are rotated respectively in arrow directions from a state illustrated in FIG. 5B by an angle equivalent to two blades. Because of the rotation, two side ends of the recording media to be stored 10*b*1 and 10*b*2 are pressed toward the base member 21 by next blades in the rotating directions of the impellers 25 and 26. In other words, by rotating the impellers 25 and 26, two side ends of the recording media to be stored 10*b*1 and 10*b*2 are moved from the storage position where the two side ends are in contact with the sheet contact section 31, to the pushup position where the contact is released. In this manner, the two side ends of each of the recording media to be stored 10*b*1 and 10*b*2 move to a side of the lift tables 45 and 46. At this time, the lift tables 45 and 46 are located at lower positions than the sheet contact section 31, as described previously. Therefore, the two side ends of each of the recording media to be stored 10*b*1 and 10*b*2 can be smoothly moved to the side of the lift tables 45 and 46. As the impellers 25 and 26 thus rotate, two ends of each of the recording media to be stored 10*b*1 and 10*b*2 are bent in a direction opposite to a bending direction in a state in which the recording media to be stored are bent by the tension guide section 24.

Further, whether there are recording media to be stored 10*c*1 and 10*c*2 to be stored next or not is determined (step S6). Information concerning whether there are recording media to be stored to be stored next or not is included in information which the controller of the stacking device 1 is notified of from the controller of the image formation apparatus.

In step S6, if there are recording media to be stored to be stored next (Yes), the recording medium to be stored 10*c*1 has been conveyed immediately after the recording medium to be stored 10*b*2, as illustrated in FIG. 5A, and processing goes to step S7. At this time, As illustrated in FIG. 6, the impellers 25 and 26 rotate thereby creating a new space to store the recording medium to be stored 10*c*1.

That is, as illustrated in FIG. 7A, the recording medium to be stored 10*c*1 is stored into a space created between other blades of the impellers 25 and 26 that those between which the recording media to be stored 10*b*1 and 10*b*2 are stored.

At the same time when the recording medium to be stored 10*c*1 is stored, the lift tables 45 and 46 are raised along the guide axles 44 (step S7), to push up the recording media to be stored 10*b*1 and 10*b*2 stacked and aligned. The recording media to be stored 10*b*1 and 10*b*2 pushed up are nipped by the paired pickup rollers 14 rotating.

Thereafter, the recording media to be stored 10*b*1 and 10*b*2 are conveyed to the post-processing machine for a later process through the carry-out guide 15 by the paired carry-out rollers 16. At this time, the newly stored recording medium to be stored 10*c*1 is not in contact with the lift tables 45 and 46, and therefore, only the recording media to be stored 10*b*1 and 10*b*2 can be pushed up, as illustrated in FIG. 7B. Further, processing returns to step S3, and a specified number of recording media to be stored are stored.

Thus, by rotating the impellers 25 and 26, an operation of conveying out the recording media to be stored 10*b*1 and 10*b*2 and an operation of conveying in the recording media to be stored 10*c*1 and 10*c*2 can be performed simultaneously, and high-speed processing can be thereby achieved. The lift tables 45 and 46 return to the down position before the operation of conveying in the next recording media to be stored 10*c*1 and 10*c*2 starts after the operation of conveying out the recording media to be stored 10*b*1 and 10*b*2 ends.

Otherwise, if there are no recording media to be stored to be stored next (No) in step S6, processing goes to step S8, and the lift tables 45 and 46 are raised to the up position, thereby to convey the recording media to be stored 10*b*1 and 10*b*2 stacked and aligned, to the post-processing machine for a later process, as illustrated in FIGS. 5A and 5B. A series of sequence is then terminated.

As has been described above, in the stacking device according to the invention, a top end bent by the guide section is brought into contact with the sheet contact section when a recording medium is stored into the storage space A. The recording medium is therefore stored so as to stand up tensioned. Therefore, even a soft recording medium is prevented from becoming puckered by, for example, breakdown (bending or twisting) due to contact, and jam errors are prevented.

Further, by keeping recording media parallel to the direction of gravity, an installation area occupied by the stacking device can be reduced to a small size. Accordingly, when the stacking device is mounted on an image formation apparatus or a sorter, increase in apparatus area can be suppressed to be small.

The stacking device comprises a disposal path in addition to a conveyance path for delivering recording media to the post-processing machine for a later process. When the stacking device is mounted on a printer or a copying machine, unwanted media are sorted out for stacking for trial printing, and output to the disposal tray. Accordingly, unwanted recording media are not stored but are prevented from being delivered to the post-processing machine in the rear step, and manual work for taking out recording media can be omitted.

The two paths are switched from each other, i.e., selected by moving the sheet contact section 31 provided at a bottom of the storage space A, parallel to an installation surface thereof, like a shutter. Further, recording media which have been once stored in the storage space A can be securely ejected to a side of the disposal path, by rotating the paddle rollers 28 and 29 to push out the recording media and by further causing the paired eject rollers 17 to nip and take out the recording media, after retracting the sheet contact section 31.

The sheet contact section 31 which stores recording media, and the lift tables 45 and 46 which push up the recording media are located with a step and a gap maintained between each other. The sheet contact section 31 is started to move from the non-contact position to the contact position at a timing at which a last unwanted recording medium is nipped by the paired eject rollers 17. Therefore, an unwanted recording medium is ejected by the paired eject rollers 17 since the gap is created although the sheet contact section 31 is in contact with unwanted recording media. In addition, since the sheet contact section 31 is at the contact position while unwanted recording media are ejected. Therefore, even if an unwanted recording medium and a recording medium to stack are conveyed in, situated close to each other, the recording medium to stack can be securely stored.

Further, by merely rotating the impellers 25 and 26 holding two side ends of a specified number of recording media stacked and aligned, the two side ends of the recording media can be moved from the contact position on the sheet contact section 31 to the pushup position depending on the lift tables 45 and 46. In addition, the recording media are pushed up, guided by blades, and can accordingly be conveyed to the carry-out rollers without putting the recording media out of order.

Hereinafter, descriptions will be made of an example of mounting the stacking device according to the embodiment of the invention on an image forming apparatus, such as an Inkjet printer, in which images are formed on a rolled continuous recording medium (e.g., roll paper) or a fan-folded continuous recording medium.

Figure 10:
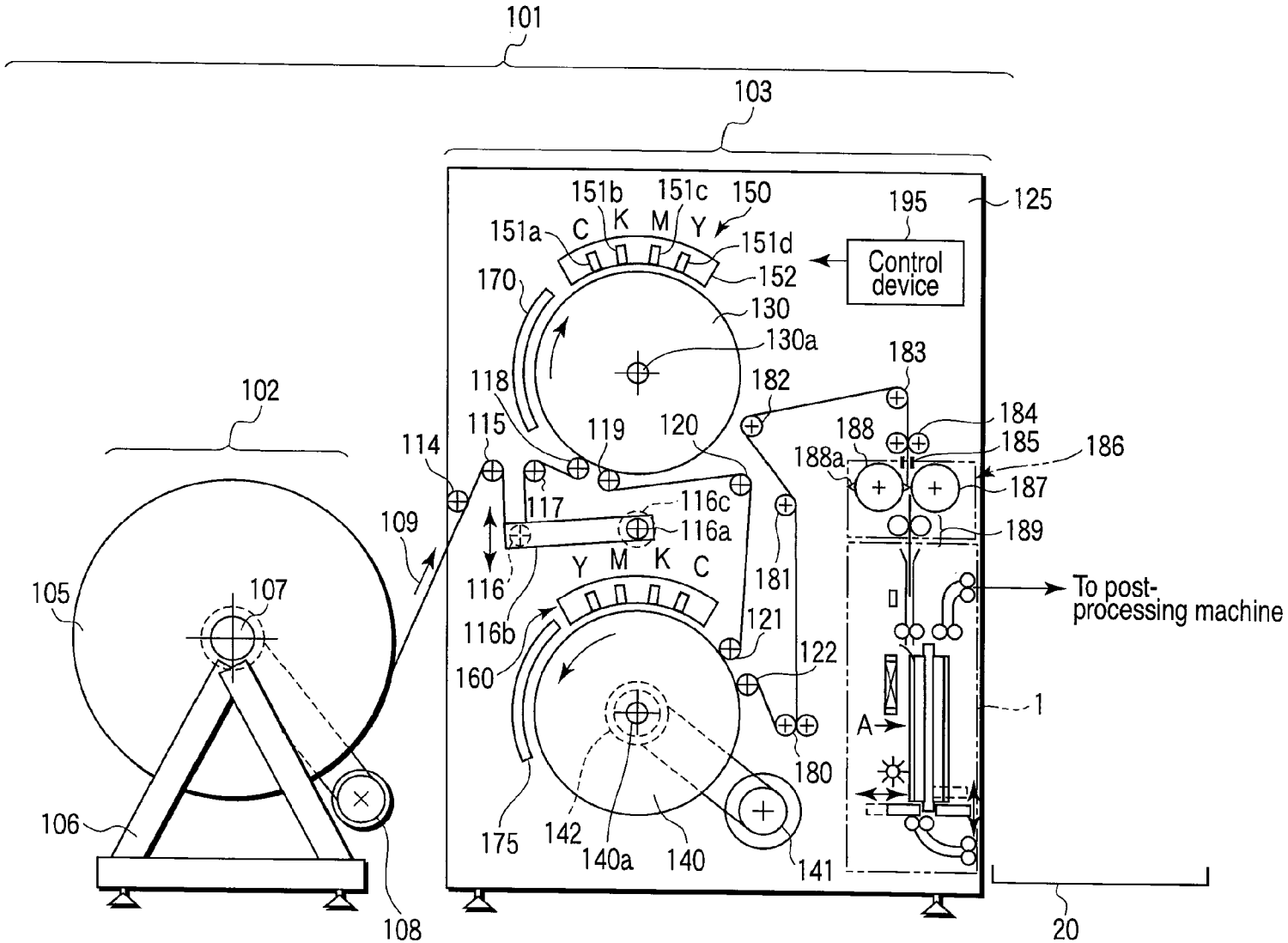
FIG. 10 illustrates an example configuration in which the stacking device according to the invention is mounted on an image forming apparatus for forming images on a continuous recording medium.

FIG. 10 illustrates an example configuration in which a stacking device according to the embodiment of the invention is mounted on an image forming apparatus for forming images on a continuous recording medium. A configuration and reference symbols of the stacking device 1 in FIG. 10 will be omitted from descriptions below, by referring to FIG. 1C.

In the present embodiment, a stacking device is located below a cutter section 186 in an image forming apparatus 101.

Hereinafter, the image forming apparatus 101 will be described.

The image forming apparatus 101 comprises an unwinder section 102 and a printer section 103. The unwinder section 102 will now be described first.

The unwinder section 102 comprises a stand 106, a roll former fixing shaft 107, and a brake 108. The unwinder section 102 is a recording-media supply section which holds a continuous medium 105 to be rotatable by the roll former fixing shaft 107, and supplies the continuous medium 105 to the printer section 103.

In the present embodiment, the unwinder section 102 uses roll paper as the continuous medium. The stand 106 supports the roll former fixing shaft 107 to be rotatable. From the roll former fixing shaft 107, a plurality of claw parts protrude in radial directions, to chuck an inner diameter of a roll former by injecting air from an unillustrated air injection port. As a result, the claw parts of the roll former fixing shaft 107 bite into the inner diameter of the roll former of the continuous medium 105, and firmly hold the continuous medium 105.

The roll former fixing shaft 107 is connected to the brake 108 by a pulley and a belt. A braking force of the brake 108 is transmitted to the roll former fixing shaft 107. In this manner, the brake 108 serves a function to apply a tension in a direction opposite to a conveying direction of the continuous medium 105.

Subsequently, the printer section 103 will be described.

As illustrated in FIG. 10, the printer section 103 is constituted by: a plurality of rollers 114 to 122 and 180 to 184; a conveyor section for the recording medium 105, which is constituted by a first drum 130 and a second drum 140; a cut section 186; a body frame 125; a first recording section 150; a second recording section 160; a first cleaning unit 170; a second cleaning unit 175; a control device 195; a stacking device 1; and a disposal tray 20. The printer section 103 introduces the continuous medium 105 red from the unwinder section 102, as indicated by an arrow 109.

The control device 195 controls at least: operations of the unwinder section 102 as the recording medium supply section; the conveyor section to convey the continuous medium; the first recording section 150 and second recording section 160 as an image forming section; the first cleaning unit 170 and second cleaning unit 175 cleaning section; the cutter section 186; and the stacking device 1.

The continuous medium 105 introduced into the printer section 103 is conveyed to the first drum 130 through a conveyor system which is constituted by free rollers 114 and 115, a swing roller, free rollers 117 and 118. The swing roller 116 is attached to a top end of an arm 116*b* which is held to be pivotable about a pivot center 116*a* on the body frame 125 in a manner that the swing roller 116 is rotatable in regular and reverse directions. Further, the swing roller 116 constitutes a tension generation section which tensions the continuous medium 105 conveyed along a lower circumferential surface of the swing roller 116 by the dead weight of the swing roller 116 and arm 116*b*.

Further, even if the continuous medium 105 is loosened by fluctuation of the tension which is caused by eccentricity of the continuous medium 105 held by the unwinder section 102, the aforementioned tension generation section has a function to eliminate looseness.

The pivot center 116*a* is provided with a potentiometer 116*c* which detects a pivot position when the swing roller 116 moves in vertical directions. Depending on an output signal of the potentiometer 116*c*, the brake 108 connected to the roll former fixing shaft 107 of the unwinder section 102 is operated. In this manner, the tension of the continuous medium 105 is controlled. The free rollers 114, 115, 117, and 118 are rotatably supported by the body frame 125.

The continuous medium 105 conveyed to the first drum 130 through the aforementioned conveyor system is wound about the first drum 130 to a winding angle of 330 degrees by the free rollers 118 and 119. The first drum 130 is, for example, a hollow cylinder made of aluminum, and a rotation axle 130*a* is rotatably supported by the body frame 125. Further, the continuous medium 105 held on the first drum 130 is conveyed to immediately below the first recording section 150 provided to face the first drum 130, and recording is performed on a surface of the continuous medium 105 by the first recording section 150.

A winding angle of the continuous medium 105 which is wound about the first drum 130 is thus ensured to be as wide as 330 degrees or so, as in the present embodiment. Therefore, the continuous medium 105 can be held in tight contact with the first drum 130, without a slip between the first drum 130 and the continuous medium 105. As a result, accurate conveyance of a paper sheet and accurate rotational speed control of the drum can be achieved.

The continuous medium 105 following an end of winding about the first drum 130, or namely, the continuous medium 105 having a surface on which an image has been recorded is conveyed to the second drum 140 through the conveyor system of the free rollers 119, 120, and 121.

The continuous medium 105 conveyed to the second drum 140 is wound about the second drum 140 to a winding angle of 330 degrees by the free rollers 121 and 122, as in the first drum 130.

The second drum 140 is also, for example, a hollow cylinder made of aluminum, and is rotatably supported by the body frame 125. In addition, the free rollers 119, 120, 121, and 122 are rotatably supported by the body frame 125.

The continuous medium 105 which is wound about the second drum 140 by the winding angle of 330 degrees as described above applies a normal force to an outer circumferential surface of the second drum 140 because of tensions at the beginning and the end of winding.

As a result, a friction force is large between the second drum 140 and the continuous medium 105, and prevents a slip between the second drum 140 and the continuous medium 105. Accordingly, the continuous medium 105 is held in tight contact with the second drum 140.

The second drum 140 rotates in an anticlockwise direction in the figure by a driving force of a drive motor 141 connected to a rotation axle 140*a* by a pulley and a belt. Thus, the second drum 140 functions as a drive drum, and the first drum 130 is a slave drum which is rotated in a clockwise direction by the second drum 140 through the continuous medium 105.

Further, in accordance with rotation of the second drum 140, the continuous medium 105 which is held on the second drum 140 is conveyed to immediately below the second recording section 160 provided so as to face the second arum 140.

The continuous medium 103 which is wound about and held on the second drum 140 has an image recording surface on which the first recording section 150 has performed recording by the first drum 130. The image recording surface is oriented downward (to a side of a circumferential surface of the second drum 140), and a back surface of the image recording surface is oriented upward (in a direction of facing the second recording section 160).

Recording is performed, by the second recording section 160, on the back surface of the continuous medium 105 which has been conveyed to immediately below the second recording section 160, held on and wound about the second drum 140. Two-sided recording on the continuous medium 105 is thereby completed.

An encoder in a post lion detector is also connected to the rotation axle 140*a* of the second drum 140. The encoder rotates in accordance with rotation of the second drum 140, and outputs a detection pulse corresponding to the rotational position of the second drum 140.

Further, the detection pulse output from the encoder is input through the control device 195 to an unillustrated drive board which drives recording heads of the first recording section 150 and second recording section 160. In synchronization with the detection pulse, the recording heads discharge ink under control of the drive board.

That is, the continuous medium 105 is conveyed at a uniform speed without slipping on the first drum 130 or the second drum 140. Therefore, driving of discharge from the first recording section 150 and second recording section 160 can be controlled, based on the detection pulse which is output in accordance with rotation of the second drum 140.

Subsequently, the first recording section 150 and second recording section 160 will be described. The first recording section 150 has the same configuration as the second recording section 160, and only the first recording section 150 will be described as a representative.

The first recording section 150 according to the present embodiment comprises recording head sections 151*a*, 151*b*, 151*c*, and 151*d* for total four colors of cyan (C), black (K), magenta (M), and yellow (Y). In the present embodiment, the recording head sections 151*a*, 151*b*, 151*c*, and 151*d* are constituted by a plurality of recording heads. The plurality of heads are fixed to a head holder plate 152 over a width equal to or longer than a width of the continuous medium 105. A nozzle surface formed on each recording head is opposed to a print surface of the continuous medium 105 held on the outer circumferential surface of the first drum 130. Relative positions of the head holder plate 152 and the first drum 130 to each other are determined by an unillustrated member.

Subsequently, the first cleaning unit 170 and second cleaning unit 175 will be described. The first cleaning unit 170 and second cleaning unit 175 are provided to clean the recording head sections, and have a function to perform cleaning operations, such as known wiping and nozzle suction.

When the first recording section 150 is cleaned by the first cleaning unit 170, the head holder plate 152 is retracted in a direction of moving away from a circumferential surface of the first drum 130 by an unillustrated retraction mechanism. Accordingly, the recording head sections 151*a*, 151*b*, 151*c*, and 151*d* are moved in the direction of moving away from the circumferential surface of the first drum 130, and a predetermined gap is created between lower surfaces of the recording head sections 151*a*, 151*b*, 151*c*, and 151*d* and the circumferential surface of the first drum 130.

Thereafter, the first cleaning unit 170 is moved to immediately below the recording head sections 151*a*, 151*b*, 151*c*, and 151*d*, and cleaning is performed on the recording head sections 151*a*, 151*b*, 151*c*, and 151*d*. After completion of the cleaning operation, the first cleaning unit 170 returns to a standby position as illustrated in FIG. 10, and the first recording section 150 returns to an image recording position. A cleaning operation for the first recording section 150 is performed by the second cleaning unit 175 in the same manner as described above.

As described previously, behind the end of winding of the continuous medium 105 about the second drum 140, the continuous medium 105, two-sided recording of which has been completed by performing recording on a surface by the first recording section 150 as well as on a back surface by the second recording section 160, is conveyed by the conveyor system following the free roller 122.

The continuous medium 105 following the end of winding about the second drum 140 is conveyed to paired first nip rollers 130. The paired first nip rollers 180 are rotatably supported by the body frame 125.

The paired first nip rollers 180 are constituted by a pair of rollers. Though not particularly illustrated, a torque limiter, a reduction gear, and a drive motor are connected to one of the pair of rollers, and convey the continuous medium 105 at the same speed as the conveying speed of the continuous medium 105 on the first drum 130 and second drum 140.

In this manner, the paired first nip rollers 180 constitute a tension generation section to tension the continuous medium 105 in the same direction as the conveying direction.

After the paired first nip rollers 180, the continuous medium 103 is conveyed by paired second nip rollers 184 through free rollers 181, 182, and 183. The free rollers 181, 182, and 183 and the paired second nip rollers 184 are also rotatably supported by the body frame 125.

The paired second nip rollers 184 are constituted by a pair of rollers. Though not particularly illustrated, a torque limiter, a reduction gear, and a drive motor are connected to one of the pair of rollers, and convey the continuous medium 105 toward an insertion guide 185 provided immediately behind, at the same speed as the conveying speed at which the continuous medium 105 is conveyed by the paired first nip rollers 180.

The insertion guide 185 functions to restrict fluctuation of the continuous medium 105 in a thickness direction in this conveyance path, and to insert the continuous medium 105 into the cutter section 186.

The insertion guide 185 is configured to extend in a width direction of the continuous medium 105, cover two surfaces of the continuous medium 105, and restrict the conveyance path. The insertion guide 185 is a component which is made of, for example, sheet metal or molded resin. Alternatively, the insertion guide 185 may be made of paired elongate rollers.

The continuous medium 105 is inserted into the cutter section 186 through the insertion guide 185 from the paired second nip rollers 184. A conveyance path between the paired second nip rollers 184 and the cutter section 186 is configured to be as short as possible.

The cutter section 186 is constituted by an anvil roller 187, a cutter roller 188 opposed to the anvil roller 187, and a brush roller 189 provided in a downstream side of the anvil roller 187 and cutter roller 188 along the conveying direction.

The cutter roller 188 is provided with cutter blades 188*a*. In the present embodiment, two cutter blades 188*a* are provided at equal intervals on an outer circumferential surface of the cutter roller 188.

Further, the cutter roller 188 and anvil roller 187 are rotated at the same speed as the conveying speed of the continuous medium 105 on the first drum 130 and second drum 140 and the conveying speed of the continuous medium 105 conveyed by the paired second nip rollers 184 as well. In this manner, the continuous medium 105 can be sequentially cut into sheets of recording media 10 each having a predetermined size.

A friction member made of rubber, a sponge, or any other material is formed on an outer circumferential surface of the brush roller 189. In the present embodiment, a number of linear members which extend in radial directions of the roller are implanted as the friction member. The brush roller 189 prevents a top end of the continuous medium 105 cut by the cutter roller 18*b* from being rolled in by the cutter roller 188 or the anvil roller 187. Therefore, a linear speed b of outermost circumference of the brush roller 189 is set to be taster than a linear speed a of the cutter blades 188*a* of the cutter blades 188*a*. In this manner, the continuous medium 105 can be conveyed without being loosened. The cutter section 186 is configured to be replaceable. Recording media of a plurality of sizes can be output by changing a diameter of the roller and by replacing the cutter section with another cutter section capable of cutting into a desired size.

Sheets of recording media 10 cut by the cutter section 186 are conveyed into the stacking device 1. The stacking device 1 is provided vertically below the cutter section 186, and stacks, aligns, and delivers the sheets of recording media 10 to a post-processing machine, as described previously. Detailed descriptions to a configuration and operations of the stacking device 1 will be omitted herefrom.

In an image forming apparatus in which images are formed by using a continuous recording medium such as roll paper, the continuous recording medium with no image formed thereon remains on a conveyance path from recording heads to a cutter section after completion of a previous image forming operation. Further, when an image forming operation is performed next, the continuous recording medium remaining from the recording heads to the cutter section need be disposed of as an unwanted recording medium. However, the unwanted recording medium is disposed of into a disposal tray 20 by providing the stacking device 1. Therefore, recording media to be stored can be stored and conveyed out to the post-processing machine. That is, the stacking device 1 is capable of continuously performing a disposal process of disposing of an unwanted recording medium and a storage process of storing recording media to be stored, without stopping the device, as described previously.

When recording media which are stacked by the stacking device 1 according to the present embodiment are bound up into a booklet, images for first to last pages of one booklet are sequentially formed on a continuous medium and cut out by the image forming apparatus, and the pages are conveyed into the stacking device. Binding into a booklet can thus be realized.

As described previously, the image formation apparatus which forms images on the continuous medium 105 disposes of a part of the continuous recording medium 105 which remains at least on the conveyance path from the first recording section 1 at the first drum 130 to the cutter section 186, when image formation is started. The part of the continuous recording medium 105 to be disposed of is cut and ejected by the cutter section 186. Alternatively, however, a cutter blade 188*a* may be moved from a cutting position, and the long continuous recording medium 105 may be weaved through between rollers and disposed of, maintaining its length.

The stacking device according to the present embodiment can cause an unwanted recording medium to pass the retracted sheet contact section 31, convey a cut recording medium to the recording-media disposal section 5, and automatically dispose of the cut recording medium onto the disposal tray 20. Accordingly, workers need not carry out an operation of taking out unwanted recording media stored in the storage space.

Since the stacking device is provided below the cutter section, increase in installation area of the image forming apparatus including the stacking device can be restricted to a minimum, and size reduction is achieved.

According to the invention, there can be provided a stacking device which can perform high-speed processing and is small in size, and an image forming apparatus comprising the stacking device.

What is claimed is:

1. A stacking device including a carry-out section which stores a plurality of sheets of recording media conveyed in from a carry-in section, into a storage space formed along vertical directions, and delivers the stored plurality of recording media to a device for a later process, the stacking device further comprising:

a contact section with which top ends of the recording media in a conveying direction, conveyed into the storage space, make contact to stop the recording media at a storage position;

a media move section which comprises a plurality of partition members, forms a plurality of spaces capable of storing the recording media between the partition members, stores the recording media stopped at the storage positron into arbitrary one of the plurality of spaces, and moves the partition members thereby to move at least a part of the top ends of the recording media to a pushup position different from the storage position; and a lift section which pushes up, to the carry-out section, the recording media moved to the pushup position by the media move section.

2. The stacking device of claim 1, further comprising:

a disposal section which is provided vertically below the contact section and stores an unwanted recording medium; and a contact drive section which moves the contact section to a contact positron where the contact section is in contact with the top ends of the recording media and to a non-contact position where the contact section is out of contact with the top ends of the recording media.

3. The stacking device of claim 2, wherein the disposal section comprises a pair of eject rollers which eject the unwanted recording medium, and a disposal tray which stores the unwanted recording medium ejected by the pair of eject rollers, and before a rear end of the unwanted recording medium in the conveying direction passes the eject rollers, the contact drive section moves the contact section from the non-contact position to the contact position.

4. The stacking device of claim 1, wherein the lift section comprises a lift table, on which the plurality of recording media moved to the pushup position are set and which moves the plurality of recording media, and a lift table drive section which moves the lift table to an up position where the plurality of recording media are delivered to the carry-out section and to a down position which is lower in the vertical direction than the storage position.

5. The stacking device of claim 4, wherein at the down position, a gap which allows the recording media to pass is created between a lower surface of the contact section and an upper surface of the lift table.

6. The stacking device of claim 5, further comprising:

a disposal section comprising a pair of eject rollers, which are provided vertically below the contact section and eject an unwanted recording medium, and a disposal tray which stores the unwanted recording medium ejected by the pair of ejected rollers; and a contact drive section which moves the contact section to a contact position where the contact section is in contact with the top ends of the recording media and to a non-contact position where the contact section is out of contact with the top ends of the recording media, wherein when the contact section is moved from the non-contact position to the contact position before a rear end of the unwanted recording medium in the conveying direction passes the eject rollers, the unwanted recording medium is ejected through the gap.

7. The stacking device of claim 4, wherein the pushup position is where at least a part of the top ends of the recording media is out of contact with the contact section.

8. The stacking device of claim 1, wherein the pushup position is where at least a part of the top ends of the recording media is out of contact with the contact section.

9. The stacking device of claim 1, further comprising a carry-in guide section which conveys in a recording medium, following the recording media stopped in contact with the contact section, in a manner that a top end thereof in the conveying direction is brought into contact with the stopped recording media from an oblique direction to the stopped recording media.

10. The stacking device of claim 9, further comprising a fan section which creates a gap to the guide member by blowing away rear ends of the recording media stopped in contact with the contact section, under air pressure.

11. The stacking device of claim 9, further comprising a conveyor assist mechanism which is provided vertically below the carry-in guide section, and assists conveyance of the conveyed recording media to the contact section.

12. The stacking device of claim 1, further comprising a guide section which bends the top ends of the recording media stopped in contact with the contact section, in a manner that a normal to a surface of the contact section in contact with recording media is a center of curvature.

13. The stacking device of claim 12, wherein the media move section further bends, in an opposite direction, the recording media bent by the guide section, and moves side ends of the top ends of the recording media to the pushup position.

14. The stacking device of claim 13, wherein the pushup position is where at least a part of the top ends of the recording media is out of contact with the contact section.

15. The stacking device of claim 1, wherein when the recording media stored in the arbitrary one of the plurality of spaces is moved from the storage position to the pushup position, a recording medium to be stored next is stored into other one of the plurality of spaces than the arbitrary one by moving the partition members.

16. The stacking device of claim 1, wherein the media move section is constituted by rotors which are respectively provided in sides of two side ends of the conveyed recording media and each comprise the plurality of partition members extended in the vertical directions, and the rotors respectively hold two side ends of the plurality of recording media between the partition members of the rotors, and rotate about axes parallel to the vertical directions as rotation centers.

17. The stacking device of claim 1, further comprising a guide section which bends the top ends of the recording media stopped in contact with the contact section, in a manner that a normal to a surface of the contact section in contact with recording media is a center of curvature, wherein the media move section is constituted by rotors, which are provided in sides of two side ends of the conveyed recording media and each comprise the plurality of partition members extended in the vertical directions, and the rotors respectively hold two side ends of the plurality of recording media in arbitrary one of the plurality of spaces between the partition members of the rotors, and are rotated about axes parallel to the vertical directions as rotation centers, thereby to further bend, in an opposite direction, the recording media bent by the guide section and to move the two side ends of the top ends of the recording media to the pushup position.

18. The stacking device of claim 17, wherein when the recording media stored in the arbitrary one of the plurality of spaces is moved from the storage position to the pushup position, a recording medium to be stored next is stored into other one of the plurality of spaces than the arbitrary one by moving the partition members.

19. An image forming apparatus comprising:

a supply section which supplies a long continuous recording medium;

an image forming section which performs image forming on the continuous recording medium;

a cutter section which cuts the continuous recording medium recorded by the image forming section, into recording media each having a predetermined size;

a media conveyor section which conveys the continuous recording medium from the supply section to the cutter section;

a stacking device which is provided below the cutter section, performs a stacking process of stacking the cut recording media, and delivers the recording media stacked, to a device for a later process; and a controller which controls at least the supply section, the image forming section, the cutter section, the media conveyor section, and the stacking device, wherein the stacking device comprises a carry-in section which convoys the recording media cut by the cutter section, into a storage space formed along vertical directions, a carry-out section which delivers the recording media in a plurality stored in the storage space, to the device for the late process, a contact section with which top ends of the recording media in a conveying direction, conveyed into the storage space, make contact to stop the recording media at a storage position, a media move section which comprises a plurality of partition members, forms a plurality of spaces capable of storing the recording media between the partition members, stores the recording media stopped at the storage position into arbitrary one of the plurality of spaces, and moves the partition members thereby to moves at least a part of the top ends of the recording media to a pushup position different from the storage position, and a lift section which pushes up, to the carry-out section, the recording media moved to the pushup position by the media move section.

20. An image forming apparatus comprising:

a supply section which supplies a long continuous recording medium;

an image forming section which performs image forming on the continuous recording medium;

a cutter section which cuts the continuous recording medium recorded by the image forming section, into recording media each having a predetermined size;

a media conveyor section which conveys the continuous recording medium from the supply section to the cutter section;

a stacking device which is provided below the cutter section, performs a stacking process of stacking the cut recording media, and delivers the recording media stacked, to a device for a later process; and a controller which controls at least the supply section, the image forming section, the cutter section, the media conveyor section, and the stacking device, the stacking device comprising:

a carry-in section which conveys the recording media;

a storage section configured to store recording media to be stored, which are included among the recording media carried in by the carry-in section;

a carry-out section which delivers the recording media from the storage section to a device for post processing;

a disposal section which disposes of an unwanted recording medium which may be included in the recording media carried in by the carry-in section; and a sorter which sorts the recording media into either the storage section or the disposal section.

* * * * *